United States Patent [19]

Makhlouf

[11] Patent Number: 4,506,567

[45] Date of Patent: Mar. 26, 1985

[54] MAXIMUM CAPABILITY WRENCH

[76] Inventor: Samir B. Makhlouf, P.O. Box 543, Stony Brook, N.Y. 11790

[21] Appl. No.: 472,601

[22] Filed: Mar. 7, 1983

[51] Int. Cl.[3] ..... B25B 17/00

[52] U.S. Cl. ..... 81/57.3; 81/58.2; 81/180 B

[58] Field of Search ..... 81/57.3, 57.14, 121 A, 81/58.2, 180 B, 185, 59.1

[56] References Cited

U.S. PATENT DOCUMENTS

| | | | |
|---|---|---|---|
| 1,033,049 | 7/1912 | Chase et al. | 81/59.1 |
| 1,564,222 | 12/1925 | Dunlap | 81/185 |
| 2,376,575 | 5/1945 | Cronan | 81/58.2 |
| 4,098,151 | 7/1978 | Bliss | 81/57.3 |
| 4,265,148 | 5/1981 | Gartzke | 81/57.29 |
| 4,376,396 | 3/1983 | Hayhoe | 81/57.14 |

FOREIGN PATENT DOCUMENTS

| | | | |
|---|---|---|---|
| 351551 | 1/1961 | Switzerland | 81/59.1 |

*Primary Examiner*—James L. Jones, Jr.
*Attorney, Agent, or Firm*—Leonard Belkin

[57] ABSTRACT

A hand held open jawed wrench having an internal mechanism which permits the tool to be used when stationary and to multiply torque and force applied to a nut. There is an external take-off member to which force can be applied and an internal chain and gear drive to effect the torque multiplication. A floating jaw member is rotated by the internal mechanism and there is provision for inserts to accomodate different size nuts.

3 Claims, 8 Drawing Figures

MAXIMUM CAPABILITY WRENCH

BACKGROUND OF THE INVENTION

This invention relates to a hand held wrench with the capability of applying substantial additional amounts of torque when required and more particularly to a light weight hand held wrench with provision to transmit an external drive and to multiply the effect of the external drive.

A variety of hand tools are available to mechanics, hobbyists, "do-it-yourselfers", and others, for repairing automobiles, appliances, machines, and myriad other mechanical and electro-mechanical devices which abound in our modern society.

One of the more common frustrations for an individual who wishes to take on a repair himself is to discover that he lacks the specific tool to accomplish a specific task. For example, a basic collection of hand tools might comprise a set of socket wrenches, open and closed end wrenches, screw drivers, pliers, and hammers. However, these tools could prove to be inadequate when the individual comes up against the removal of a nut which is stubborn and requires more torque than he is able to apply, or where the work to be performed does not allow tool rotation or the use of a socket wrench.

The person faced with a problem of this type could of course obtain, at substantial expense, an over-sized or even a powered tool to resolve the predicament. A variety of special tools are available to meet such special needs, for example, the necessity to apply high torques to a nut when such is required to remove or tighten the nut. In French Pat. No. 2,314,808, there is shown a wrench-like tool with provision for the jaw to be driven through a gearing arrangement by a power drive. In U.S. Pat. No. 2,712,255 there is taught a gear-operated machine wrench for rotating propeller blade nuts. U.S. Pat. No. 4,064,772 illustrates a pneumatic tubing wrench wherein the jaw can be reversed in its direction by operating a valve. U.S. Pat. No. 4,098,151 teaches a powered wrench for tightening the brake on a locomotive.

All of the patented devices hereinabove described are relatively heavy, complicated and expensive which cannot be readily adapted for use in hand tools.

SUMMARY OF THE INVENTION

The present invention makes it possible to provide in certain hand tools the ability to impart high torque to nuts as required without the necessity of resorting to heavy, complicated, or expensive tools for that purpose, and, also, the torque can be applied in places where little or no rotational movement of the tool is possible.

In accordance with the principles of this invention there is provided a hand held wrench which is used in a conventional manner under normal circumstances but has the capability to multiply the torque applied when conditions require that extra application of force.

A preferred embodiment of this invention consists of an elongated housing of generally conventional shape having a jaw at one end to engage a nut. The jaw floats rotationally within the housing and has gear teeth on its outer periphery. The other end of the housing has a power take-off shaft of multi-sided cross section to receive a wrench or other tool. A chain and gear drive between the take-off shaft and the jaw permits transmittal and multiplication of the torque applied to the shaft delivered to the jaw with the housing held stationary. A clutch arrangement permits ratchet-like operation of the chain and gear drive.

In accordance with the principles of this invention there is combined in a hand tool the dual capability to be used as an ordinary wrench and at the same time, where needed, for torque and force multiplication.

It is thus a principal object of this invention to provide a dual function wrench with the capability of multiplying torque delivered to a nut.

Other objects and advantages of this invention will hereinafter become obvious from the following description of a preferred embodiment of this invention.

DESCRIPTION OF THE PREFERRED EMBODIMENT

Figure 1:
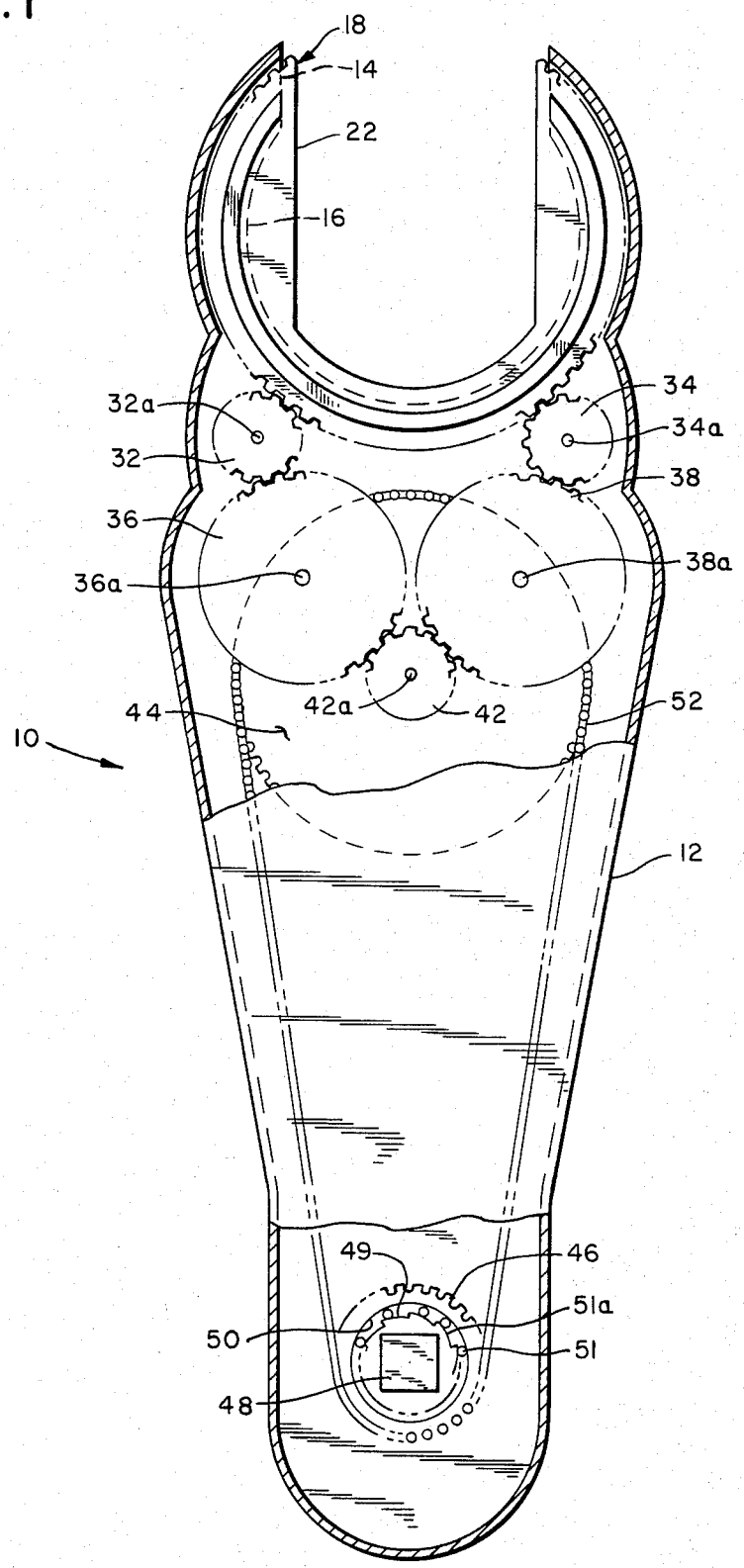
FIG. 1 is a plan view of a wrench embodying the principles of this invention with a portion of the housing cut away.
Figure 2:
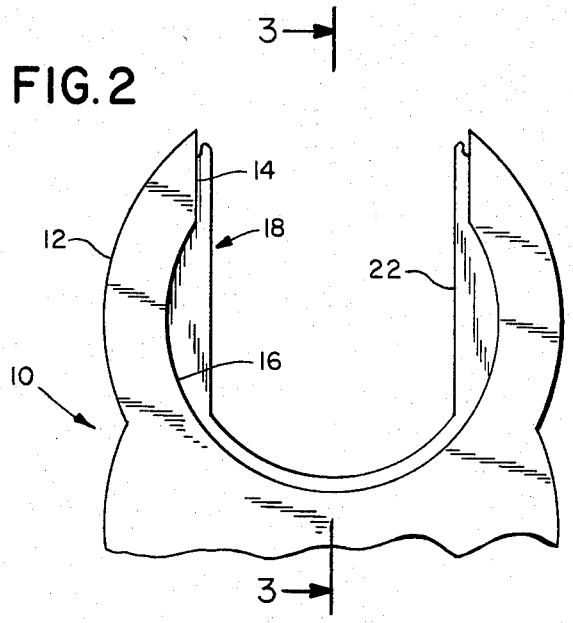
FIG. 2 is a plan view of one end of the wrench shown in FIG. 1 without the housing cut away.
Figure 3:
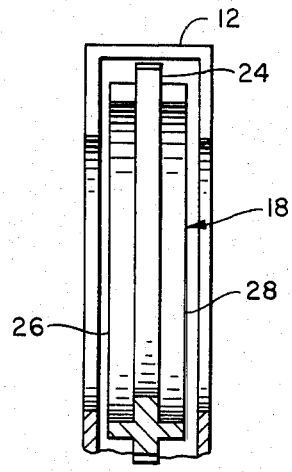
FIG. 3 is a view along 3—3 of FIG. 2.

Referring to FIGS. 1, 2, and 3, wrench 10 consists of an elongated housing 12 having at one end a cut out portion consisting of a jaw 14 with a circular lower section 16.

It will be noted that housing 12 has a circular configuration surrounding the circular lower section 16. The purpose of this shape is to accomodate and restrain within housing 12 a floating, generally circular toothed member 18 having a jaw opening 22.

As seen best in FIG. 3, jaw member 18 consists of a central section 24 and a pair of outer sections 26 and 28. Central section 24 is of larger diameter than outer sections 26 and 28 for a purpose to be described below.

As will be noted from FIG. 1, a pair of pinions 32 and 34 mounted on shafts **32*a* and 34*a*, respectively, engage toothed jaw member 18. The space between shafts 32*a* and 34*a* must be sufficiently large so that as member 18 is rotated one of pinions 32 or 34 is always engaged with member 18 even though one pinion may be at the opening 22 of member 18. Shafts 32*a* and 34*a* extend to both sides of housing 12** for support.

A pair of gears 36 and 38 supported on shafts **36*a* and 38*a*, respectively, engage pinions 32 and 34, respectively. Shafts 36*a* and 38*a* extend to and are supported on one side of housing 12** only for a reason which will be latter apparent.

Figure 4:
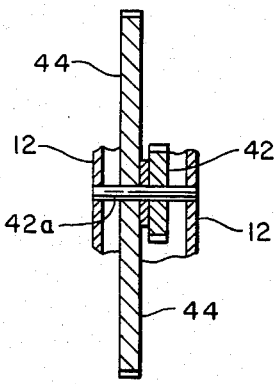
FIG. 4 is a cross sectional view of pinion 42 and toothed member 44 in place.

As seen also in FIG. 4, a single pinion 42 mounted on a shaft **42*a* extending to and supported by both sides of housing 12 engages both gears 36 and 38. Mounted also on shaft 42*a* is a large toothed element 44 connected to rotate with pinion 42**.

On the far end of wrench 10 there is shouwn an external drive gear 46 mounted on a shaft **46*a* supported on one side of housing 12. On the opposite side from shaft 46*a* is a take-off extension 48, also shown in FIG. 5, supported on a circular cam race 49 mounted within outer race 50 in gear 46. Races 50 and 49 with multiple rollers 51 in between and cam ramps 51***a* on race 49 comprise an over-running clutch, and is understood in the art, to permit ratchet-like operation of gear 46. Provision, not shown, on housing 12 may be provided, if needed or desired, to lock take-off extension 48 against rotation.

Figure 5:
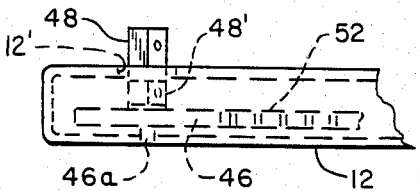
FIG. 5 is a side view of the far end of the preferred embodiment shown in FIG. 1.

Extension 48 may extend out from housing 12, as illustrated in FIG. 5, or, if desired, extension 48', in the alternative, may be short and terminate entirely within housing 12 with an opening 12' for access, rendering tool 10 even more compact. In the latter arrangement, with extension 48' entirely within housing 12, a socket would be required to engage it for driving the internal mechanism described.

Member 46 is toothed as illustrated and a chain drive 52 joins members 44 and 46 together.

It is seen from the description above that when take-off extension 48 or 48' is gripped by a wrench or socket (not illustrated) and rotated, this will cause, through drive 52, pinion 42, element 44, gears 36 and 38, and pinions 32 and 34, the rotation of jaw member 18. In the particular embodiment illustrated there is multiplication of torque in this drive of about 11:1, and force in the amount of about 80:1, sufficient to accomodate the most recalcitrant nut one is likely to face. With wrench 10 held stationary during this torue multiplication it is convenient to keep the tool properly centered to avoid applying a bending force to the bolt holding the nut.

Because wrench 10 is open-jawed, when in use it would be turned around and reversed depending on the direction of rotation.

In the use of wrench 10, with jaw member 18 in the position shown, the device can be used as an ordinary hand held open jawed wrench, that is, for example, it can be used on a pipe where there is no access to the end.

When a situation presents itself where more torque is required than can be produced by this mode of operation, this tool being typically not longer than about ten inches overall, the user of wrench 10 may resort to the internal torque multiplication mechanism just described.

In the latter mode of operation, jaw 22 would be placed on the nut (not shown) in the conventional manner, and while wrench 10 is held stationary in one hand, with the other hand the user of the tool can take any other wrench, open or closed, or socket type, and apply a torque to take-off extension 48 or 48'. This will cause rotation of jaw member 18 with the application of a torque multiplied in accordance with the gear ratios built into the mechanism. Also, the tool is easily centered on the nut and this is important when the latter is damaged where any unnecessary bending or twisting motion can result in its destruction.

Figure 6:
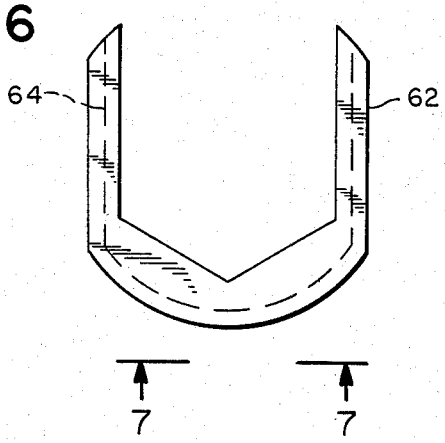
FIG. 6 is a plan view of an insert.
Figure 7:
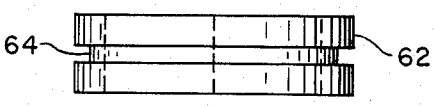
FIG. 7 is a view along 7—7 of FIG. 6.

It is noted that jaw opening 22 will fit only one size nut. For a nut which is smaller, then a jaw member insert with a smaller jaw opening may be snapped into jaw opening 22. One such insert 62 is shown in FIGS. 6 and 7. Insert 62 is provided with a groove 64 into which central section 24 of jaw member 18 fits for a snug fit. A spring loaded snap bearing member (not shown) but well known in the art may be employed to hold insert 62 in place if such is believed to be desirable or necessary.

Wrench 10 may be supplied with a complete set of inserts 62 for different sizes of nuts, and it will be noted that one of the features of this tool is that both metric and English nut sizes may be accomodated.

Figure 8:
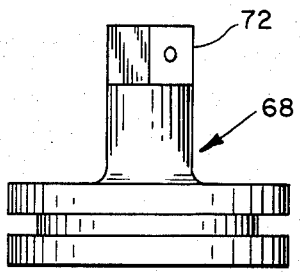
FIG. 8 is a side view of an insert which permits the tool to be operated as a socket wrench.

In the event it is desired to convert tool 10 into a socket wrench, then insert 68 shown in FIG. 8 may be used in member 18 in the same manner that an insert 62 would be utilized. Insert 18 is provided with a protuberance 72 for engagement with a socket holder (not shown) on which the proper size socket would be mounted.

The tool as described above has many features which render it useful for a variety of applications. It is a compact device which can be carried in a modest-sized tool box and is useful for the ordinary applications of a wrench. Because of its size it can be used in places where space is limited, and further, even though additional force or torque may not be required, it can be used where there is no room to rotate the tool. Thus, torque may be applied while the tool itself remains stationary, a very important advantage when used in vehicles and appliances where parts are so crowded in a limited space that very little movement if any is possible with universal tools.

This wrench makes it possible to reach places of limited access without the necessity of obtaining the special tool which otherwise might need to be obtained.

In addition, when extra force or torque is required, instead of the necessity of obtaining a larger wrench, the wrench as hereinabove described, through its internal torque multiplying mechanisms, can provide the extra torque required.

It is thus seen that there has been provided a unique, light weight and relatively inexpensive wrench with capabilities not available in existing hand tools.

While only certain preferred embodiments of this invention have been described it is understood that many variations thereof are possible without departing from the principles of this invention as defined in the appended claims.

What is claimed is:

1. A hand held multi-torque wrench comprising an elongated housing, toothed jaw means mounted within said housing adjacent one end thereof floating rotationally, said end of said housing having a jaw opening for permitting access to said jaw means, a pair of spaced pinions within said housing for engaging the toothed elements of said jaw means, a pair of gears engaging said pinions, respectively, drive pinion means engaged to drive both of said gears, a chain driven element connected to rotate with said drive pinion means, external driving means within said housing adjacent the other end thereof, overruning clutch means within said driving means to permit ratchet operation of the latter upon being rotated by an external source of power with said housing stationary, and a chain drive between said driving means and said chain driven element, said hand held wrench being selectively operable as a wrench by rotating said housing or for torque multiplication with said housing stationary and rotational force applied to said driving means, said driving means including a toothed member having a power take-off extension, said toothed member containing said overrunning clutch means, the toothed elements of said toothed member engaging said chain drive, said power take-off extension terminating within said housing, said open jaw means being comprised of central and outer sections, said central section carrying the toothed elements and said outer sections having a diameter less than that of said central section, and insert means for fitting into the jaw opening of said jaw means to accomodate nuts of smaller size, each of said insert means being slotted for mating with the central and side sections of said jaw means.

2. The wrench of claim 1 in which the spacing of said pinions are such as to insure that at least one of said pinions is always engaged with said jaw means.

3. The wrench of claim 2 having insert means for said jaw means including means for permitting use of sockets.

* * * * *